US006708609B1

(12) United States Patent
Körner et al.

(10) Patent No.: US 6,708,609 B1
(45) Date of Patent: Mar. 23, 2004

(54) PRESS PRODUCT LINE

(75) Inventors: Ekkehard Körner, Göppingen (DE); Martin Döringer, Süssen (DE)

(73) Assignee: Schuler Pressen GmbH & Co. KG, Goppingen (DE)

( * ) Notice: Subject to any disclaimer, the term of this patent is extended or adjusted under 35 U.S.C. 154(b) by 6 days.

(21) Appl. No.: 09/629,187

(22) Filed: Jul. 31, 2000

(30) Foreign Application Priority Data

Jul. 29, 1999 (DE) ..... 199 35 656

(51) Int. Cl.[7] ..... B30B 1/02
(52) U.S. Cl. ..... 100/283; 100/286
(58) Field of Search ..... 100/280, 281, 100/282, 283, 285, 286, 295, 269.17

(56) References Cited

U.S. PATENT DOCUMENTS 3,785,282 A 1/1974 Kamelander ..... 100/257
4,034,666 A * 7/1977 Bigun et al. ..... 100/231
4,434,646 A 3/1984 Maeda et al. ..... 72/451
5,845,528 A * 12/1998 Wollermann ..... 100/282
6,305,279 B1 * 10/2001 Telkamp et al. ..... 100/193

FOREIGN PATENT DOCUMENTS

EP 0101590 B1 2/1984

* cited by examiner

*Primary Examiner*—Allen Ostrager
*Assistant Examiner*—Jimmy Nguyen
(74) *Attorney, Agent, or Firm*—Crowell & Moring LLP

(57) ABSTRACT

A press product line of presses for massive forming has toggle lever transmissions for driving a slide. Different slide strokes and path-time characteristic curves of the slide movement are achieved starting with uniform blank components. The critical dimensions, i.e., the bearing locations of the toggle lever transmission on the machine frame, are constant within the entire press product line, so that at least to that extent, uniform machine frames can be used. Specially desired path-time progressions are achieved through appropriate fine machining of the blank components (eccentric, connecting rod and link bars).

12 Claims, 6 Drawing Sheets

PRESS PRODUCT LINE

CROSS-REFERENCE TO RELATED APPLICATIONS

This application is related to two other applications entitled (1) Press with Ejector Device for Different Ejector Strokes, whose inventors are Ekkehard Körner and Martin D öringer, Ser. No. 09/629,185; and (2) Press Production Series with Offset Drive, whose inventors are Ekkehard K örner and Rainer Güthle, Ser. No. 09/629,186.

BACKGROUND OF THE INVENTION

This application claims the priority of 199 35 656.4, filed on Jul. 29, 1999, the disclosure of which is expressly incorporated by reference herein.

The invention relates to a press which belongs to a press product line for massive forming and which has a machine frame, with a guided slide which is set up for the attachment of a first tool part, with a slide drive which is placed on the machine frame and which is supported on at least one bearing arrangement on the machine frame and which predetermines a path-time progression of the slide, and with a table which is placed on the machine frame opposite the slide and is set up for the attachment of a second tool part.

Mechanical presses which exhibit different strokes, for example, between 250 mm and 800 mm depending on the task for which they are being used, are frequently used for massive forming. In addition, different path-time progressions of the press slide movement can be desirable, depending on the operating conditions. A toggle lever transmission or some other kind of level transmission which connects a continuously rotating eccentric with the slide is often used as a mechanical slide drive on such presses. Different path-time progressions can thus be achieved through different transmission configurations for the slide movement.

In addition to the connection to the eccentric and to the slide, every lever transmission also has additional support points on a machine frame or other kind of framework. The curve-specific transmissions have specific support points and link points on the machine frame. The production of different presses thus requires the production and differentiation of different lever transmissions, machine frames and other press parts. All of this makes for substantial manufacturing technics effort.

DE 2127289 discloses a mechanical press with a crank toggle lever drive which exhibits two eccentrics which are arranged in a fixed angular relationship to one another, and two separate connecting rods. Both connecting rods belong to a lever transmission which exhibits a support point placed on a framework and which actuates the slide by way of a so-called bottom lever. At least two levers of the lever transmission can be changed in length in order to be able to adjust the movement of the slide. The known adjusting mechanisms are placed on moving transmission parts.

DE 3208018 A1 also discloses a press with a toggle lever transmission. Two toggle levers connected into a toggle joint are moved by of an eccentric-driven connecting rod. While one toggle lever is supported on the slide, the other toggle lever is supported on an adjusting eccentric which can be rotated by an adjusting mechanism so as to be able to adjust the movement of the slide. The adjusting mechanism must be able to cope with the forces arising at the toggle levers, which approximately match the slide forces.

Finally, DE 3230958 A1 is directed to a press with a modified toggle lever transmission. It exhibits a first link bar which is bearing-supported in pivoting fashion on a framework and which is connected with a connecting rod in pivoting fashion at a first location. At its other end, the connecting rod is bearing-supported on the eccentric and is driven by same. At an additional bearing location, which is at a distance from the first location, the connecting rod is connected to a second link bar which leads to a slide which is bearing-supported in movable manner in a slide guide. With a toggle lever transmission which has been modified in this known way, slide movements can be achieved which make possible both relatively long tool opening times, as well as a working phase which is relatively extended in terms of time (slow approach to bottom dead center).

SUMMARY OF THE INVENTION

An object of the present invention is to reduce the effort required for the production of presses with different path-time progressions of the slide movement.

In accordance with the present invention, different presses are combined into press product lines within which the presses differ only in their slide drives. All of the machine frames of the presses of a product line exhibit uniform press-general critical dimensions. In presses with modified toggle lever drives, these are, in particular, the distance between the axis of rotation of the eccentric shaft and at least one support point of the toggle lever transmission on the machine frame, as well as the distance between the axis of rotation of the eccentric shaft and the slide guide. In this way, the head pieces, which are associated with one machine frame and are from the press product line in question, can be manufactured uniformly. An adaptation to different path-time progressions of the slide movement, different stroke heights or force-path progressions, number of strokes, etc., is carried out solely through the adaptation of the slide drive.

The uniform critical dimensions also make possible not just a reduction in the number of different parts needed for a press product line, but also make possible a subsequent modification of the path-time progression of the slide movement through the exchanging of transmission parts. A modification of the machine frame, which would not be economically feasible in most cases, is thus unnecessary. For example, it is also possible to modify the path-time progression of a typical toggle lever characteristic to a characteristic closer to that of an eccentric drive, or vice-versa. The different transmission kinematics required for the different path-time progressions can be realized within a press product line without great effort. If the slide drive contains a toggle lever transmission, its elements are preferably bearing-supported directly on the press framework, which results in a rigid bearing arrangement and a simple configuration.

Adaptation to different applications is easily possible. For example, path-time progressions can be selected in which the tools stand open over as large an angle of rotation of the eccentric shaft as possible. This makes part transport easier and thus permits relatively high numbers of strokes per minute. In addition, different stroke amplitudes can be realized. Finally, it is possible to configure the kinematics in such a way that the slope of the then preferably somewhat linear path-time progression of the slide movement, as it approaches bottom dead center, does not exceed a maximum value in order to hold the maximum torque within bounds. This range forms the forming range in which the workpiece is formed. The adaptation to different kinematics is carried out while still retaining the critical dimensions in that, for example, in a modified toggle lever transmission with a connecting rod which is supported on the machine frame by a link bar and on the slide by another link bar, only the length of the link bars and their link points on the connecting rod, and thus the connecting rod, have to be modified. If necessary, the eccentric radius can also be modified. The other dimensions remain unchanged within the product line.

A further simplification is achieved here in that uniform cast blanks can be used for the press-specific eccentric and connecting rod, as well as for press-specific link bars if necessary. This is possible in that each blank has dimensions which are large enough that the desired final shape form can be produced through various metal-removing machining operations. For example, connection regions are designed onto a cast blank for the connecting rod which are large enough that a bearing bore can be put in at any desired location which is required for a certain transmission characteristic. The same is also possible for the link bars if circumstances require it.

With many presses, it is expedient to specify bottom dead center of the slide in agreement with the installed height of the tool. Primarily, this allows uniform stands to be used within a press product line so that the components of the presses of a product line can be further standardized.

It is viewed as particularly advantageous to place within the press product line uniform drives in the front of, for example, uniform clutch-brake combinations. This is achieved if all of the presses of the product line do not exceed a given maximum eccentric torque. This can be done in that the gradient of the path-time progression of the slide movement as it approaches bottom dead center does not exceed a given limit value. This limit value is preferably specified uniformly for all of the presses of a product line.

Adaptation to different numbers of strokes per minute is possible through different transmissions, which are preferably configured as planetary gear systems with uniform connection dimensions. The slide guide and the toggle lever transmission are preferably arranged so that the link bar which connects the slide with the connecting rod is aligned approximately in the direction of movement of the slide as bottom dead center is approached. In this manner, too-great or excess transverse forces on the slide are avoided, and thus an excess or too great a loading of the slide guide is also avoided.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
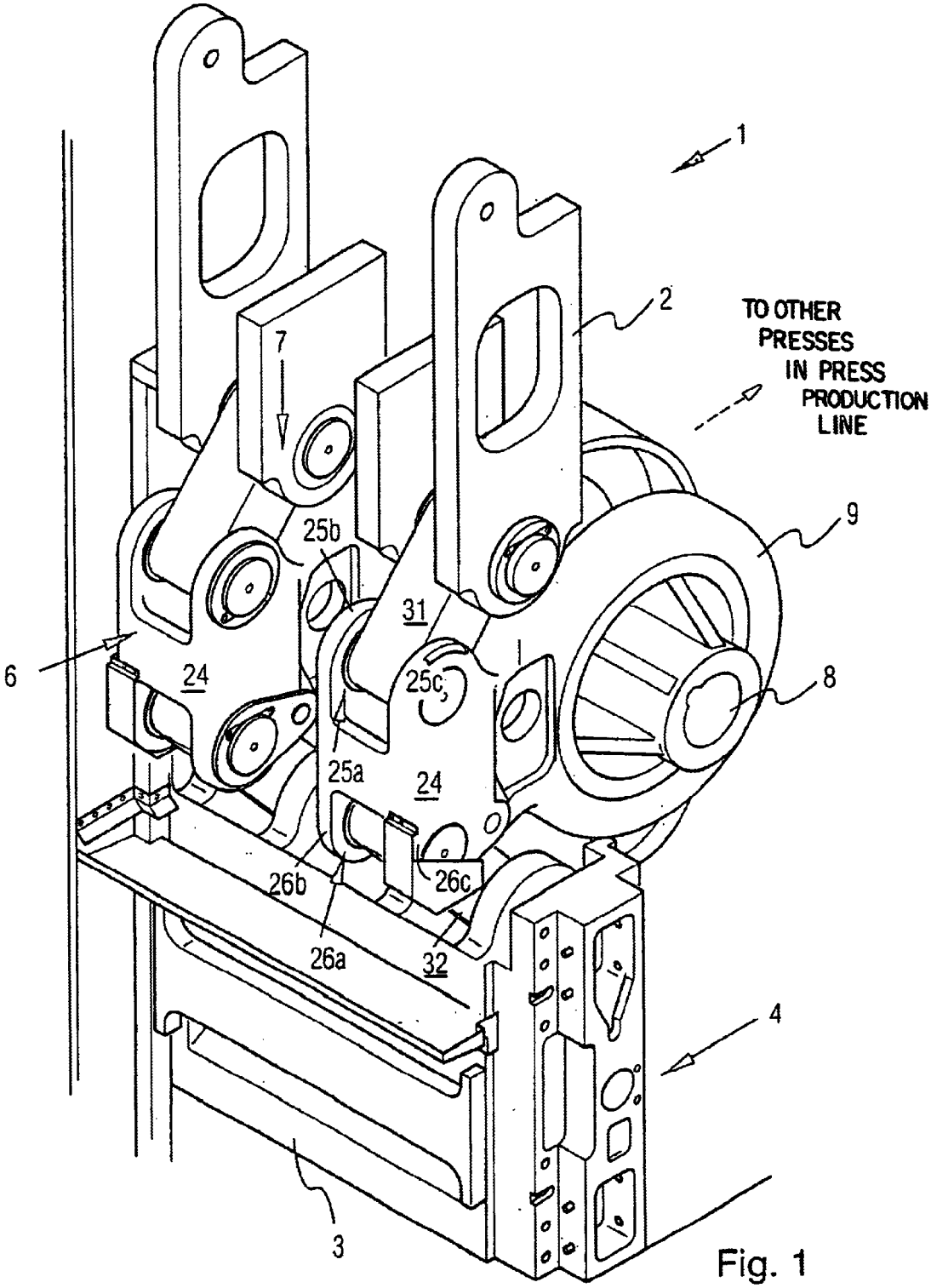
FIG. 1 is a perspective view of a toggle lever press in accordance with the present invention.

A modified toggle lever press 1 of the type illustrated in FIG. 1 is used, for example, for massive forming. A slide 3 is bearing-supported in a vertically movable manner in a machine frame 2. For guidance on the machine frame 2, a linear slide guide 4. A table 5 is illustrated underneath the slide 3 as seen schematically in FIG. 4. The table 5 is bearing-supported on or configured onto the machine frame 2 and which is used for holding a bottom tool. The slide 3 is set up or configured to hold a top tool.

Figure 2:
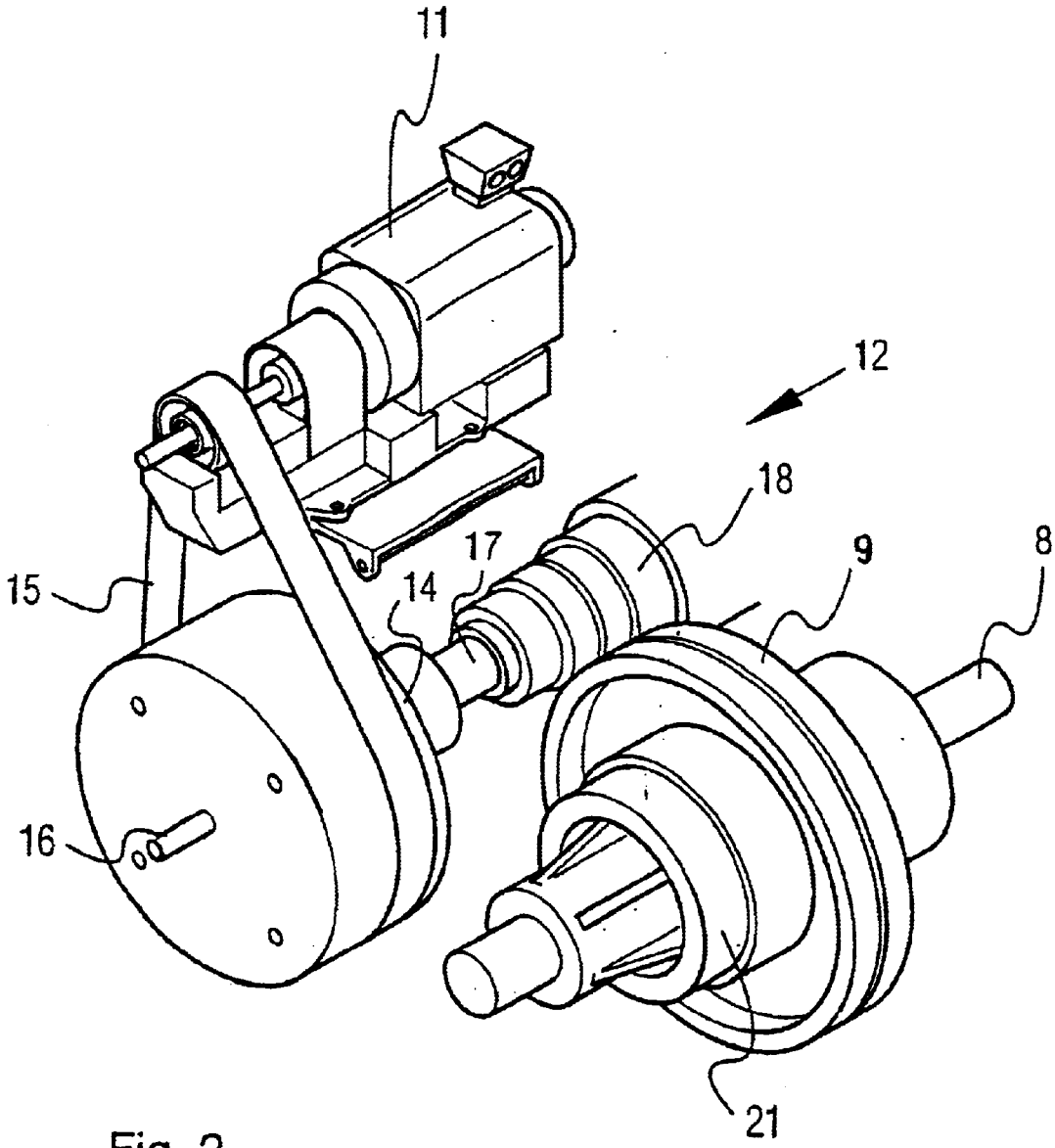
FIG. 2 is a perspective view of a drive of a toggle lever press of the type shown in FIG. 1.
Figure 1A:
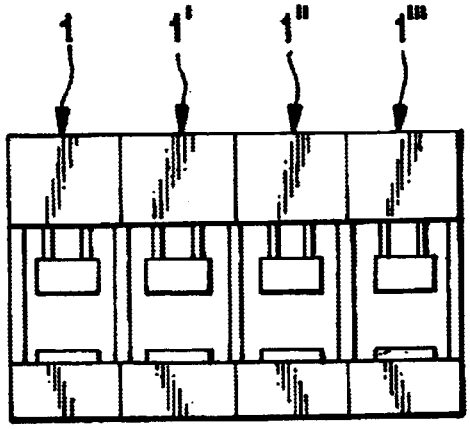

A slide drive 6 is used for driving the slide 3, and has a modified toggle lever transmission 7 which is driven by an eccentric shaft 8. The shaft 8 is driven via a transmission, a gearwheel 9, for example, by an electric motor 11, as seen in FIG. 2). An adapter transmission 12, which is preferably a planetary gear system, can be placed between the electric motor 11 and the gearwheel 9. The transmission's ring gear 14 is driven, for example, by the electric motor 11 by way of a belt 15. Its sun wheel is held by a shaft 16, preferably stationary or non-rotating, while its pinion cage drives, via a drive shaft 17, a pinion gear 18 which engages with the gearwheel 9. While using the same external dimensions, in particular, the same ring gear 14, and other connecting dimensions, the desired different transmission ratios can be achieved by exchanging the sun wheel and planet wheels.

Figure 3:
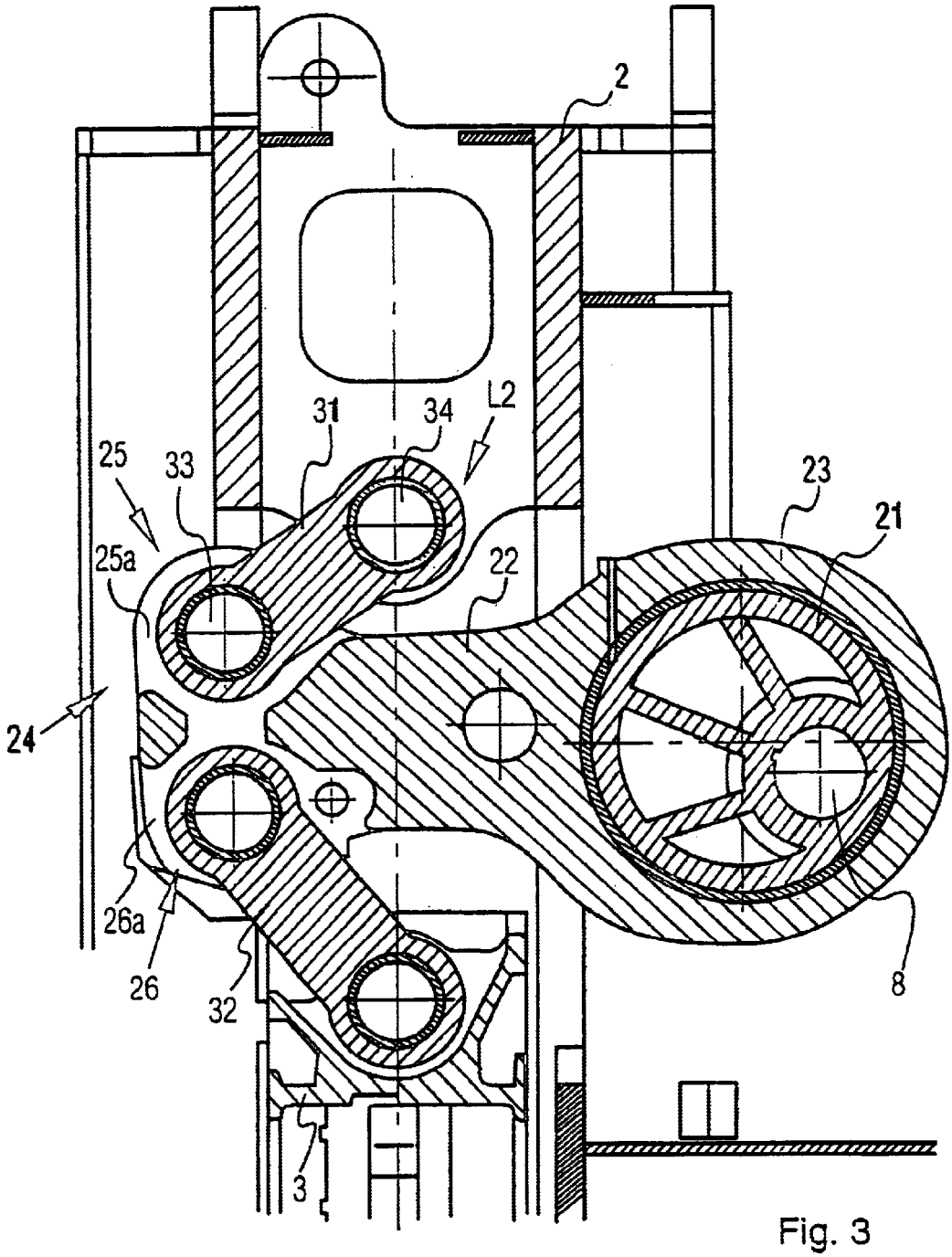
FIG. 3 is a cross-sectional view of a toggle lever press shown in FIG. 1.
Figure 4:
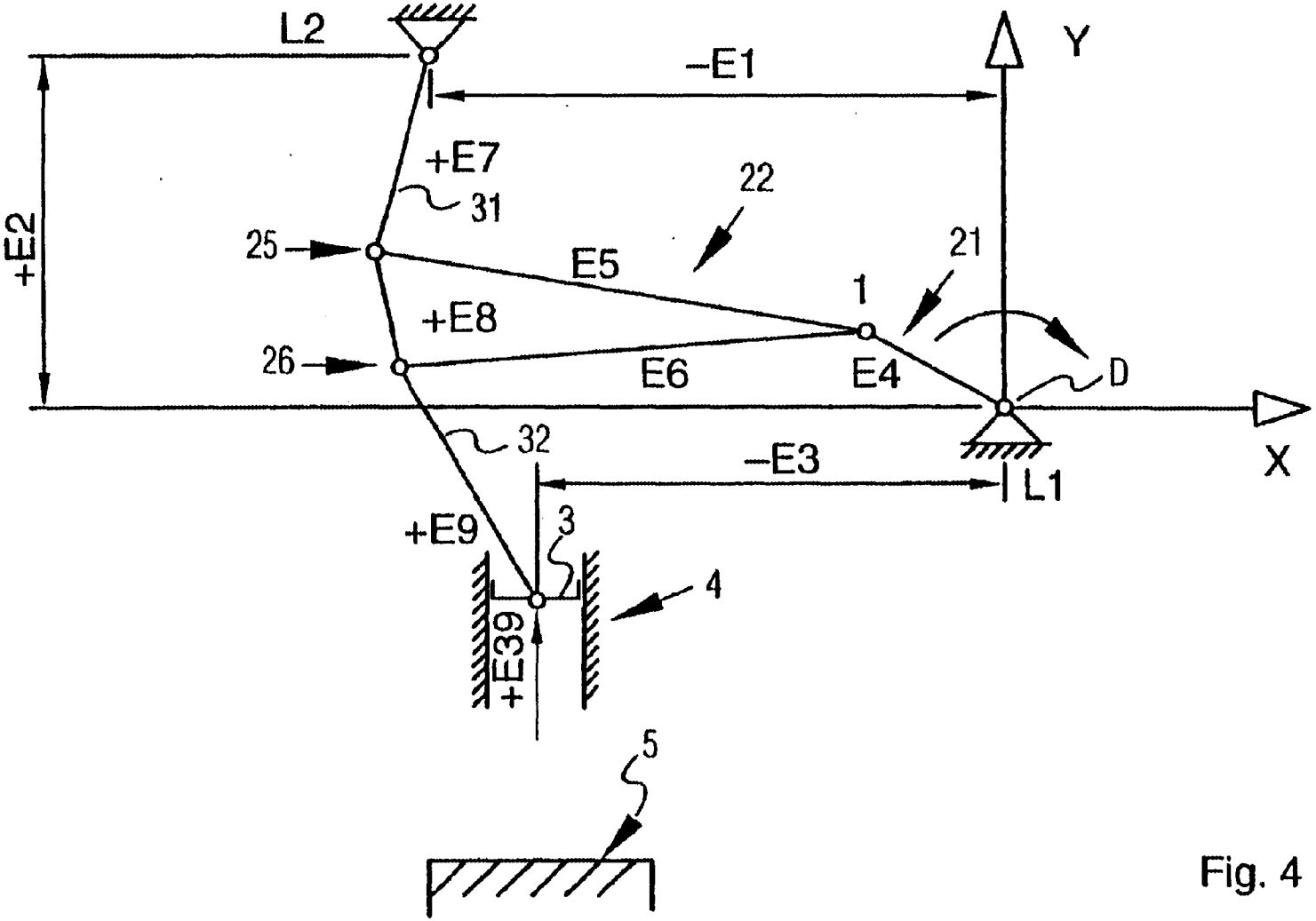
FIG. 4 is a kinematics diagram of the toggle lever press shown in FIGS. 1 and 3.

The kinematics of the toggle lever transmission 7 can be seen in FIGS. 3 and 4. An eccentric 21 rests non-rotatably on the eccentric shaft 8 which is bearing-supported in a rotating manner at a bearing location L1. Bearing-supported on the eccentric 21 is a connecting rod 22 with a corresponding connecting rod bearing 23. At its end away from the eccentric 21, the connecting rod 22 is provided with a head 24 onto which are formed two spaced bearing locations 25, 26 which form a triangle with the midpoint of the connecting rod bearing 23. This can be seen especially well in FIG. 4. The corresponding distances are identified as distances E5, E6 and E8. The eccentricity of the eccentric 21 is indicated by the dimension E4. The eccentric shaft 8 can rotate around rotation axis D which is fixed within the machine frame 2.

The bearing locations 25, 26 are formed by bores in the corresponding connection regions 25*a*, 26*a* of the connecting rod 22. As can be seen in FIG. 1, the connection regions 25*a*, 26*a* are recesses set between two plate-like walls 25*b*, 25*c*; 26*b*, 26*c* which have relatively large dimensions so that bearing bores can be made inside a relatively large region. Thus, the dimensions E5, E6 and E8 can be variably specified starting with one and the same basic connecting rod body.

The connecting rod 22 is connected to the machine frame 2 and the slide 3 by link bars 31, 32. Link bar 31 extends into the upper opening which is formed between the walls 25*b*, 25*c* of the connecting rod 21, and is pivotably bearing-supported there by way of a bearing bolt 33. At its opposite, upper end, the link bar 31 is bearing-supported on the machine frame 2 by a bearing bolt 34. The link bar 31 is symbolized in FIG. 4 by the dimension E7, while the bearing on machine frame 2 is identified by L2. The distance to the bearing location L1 of the axis of rotation D of the eccentric shaft 8 from L2 is identified by −E1 in the horizontal direction (X), and the vertical distance is identified by +E2.

The link bar 32 is shown in FIG. 4 with the distance E9. The slide 3 is bearing-supported in a movable manner in the vertical direction (Y) in the slide guide 4. The horizontal distance (X) from the link point of the link bar 32 to the slide 3 is identified in FIG. 4 by −E3.

The dimensions E1, E2 and E3 are so-called "critical" dimensions, which designate the positions of the relevant bearing locations or guides on the machine frame 2, as well as on a press head piece belonging to the machine frame 2.

The press 1 belongs to a press product line which exhibits uniform critical dimensions E1, E2, E3. In addition, the press product line exhibits eccentric shafts 8 and connecting rods 22 produced from uniform blanks. The desired special slide movement is achieved through appropriate sizing of the remaining dimensions, i.e., by specifying the dimensions E4 through E9. In that regard, the value for E4, which represents the eccentric radius, varies only within a very narrow range. This is what achieves the production of a uniform eccentric shaft casting requiring only slightly different, stroke-related metal-removing machining operations. The dimensions E6 and E9 vary more substantially, however, due to the different strokes of the path-time characteristic curves to be realized for the slide 3 and the slight variance of the value E4.

Figure 6:
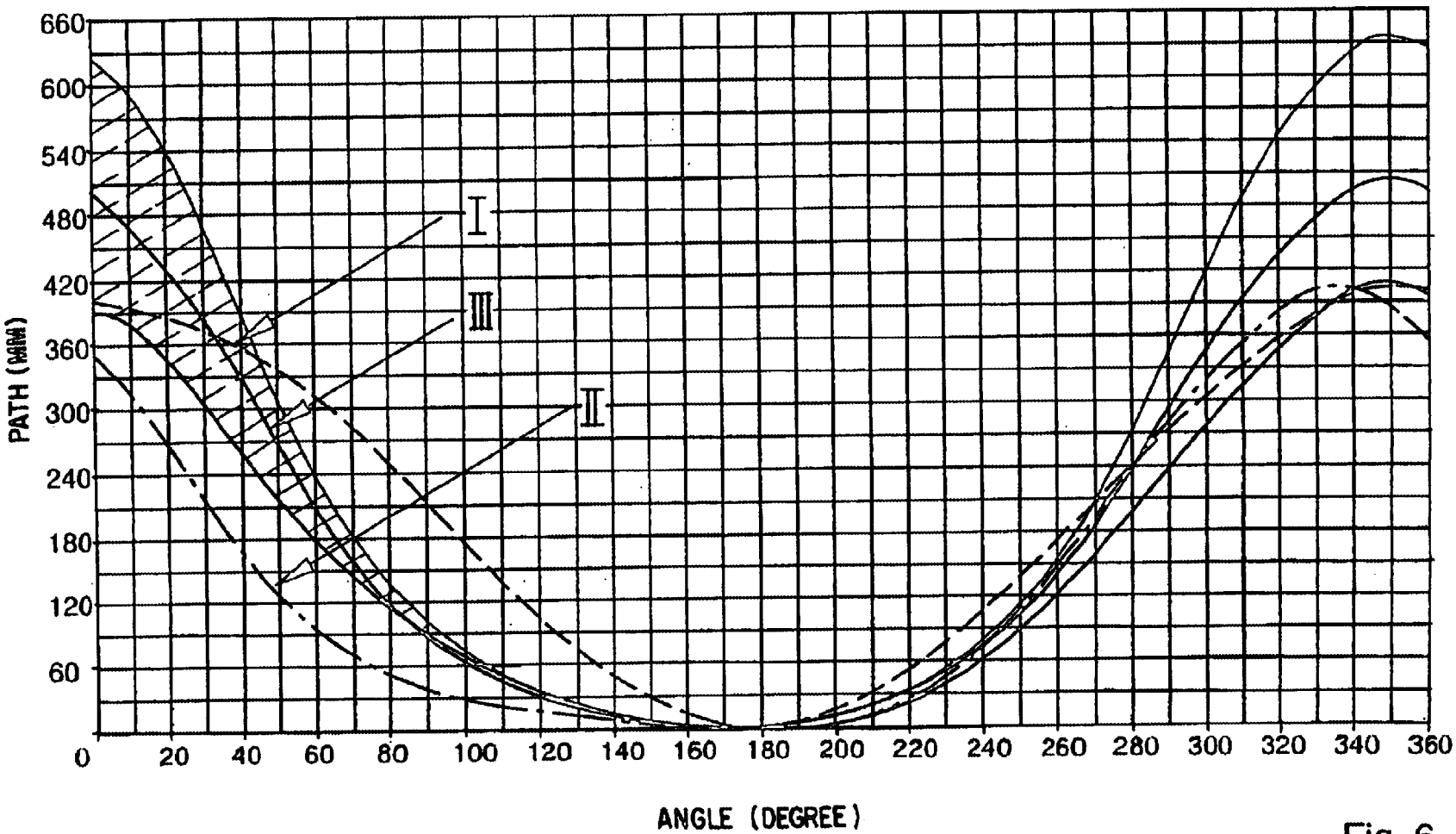
FIG. 6 is a graph of path-time progressions of the slide movement of presses with modified toggle lever transmissions compared with path-time progressions with purely eccentric characteristics or with highly modified toggle lever characteristics.

The path-time progressions to be represented are illustrated in FIG. 6 by way of examples. A broken line illustrates the path-time curve of a classic eccentric curve I. The slide 3 is raised for a relatively wide range of the angle of rotation, so that the tool is open and the transport of the parts can be carried out. This is advantageous in terms of the parts transport. A relatively fast approach to bottom dead center takes place, however, and thus results in the formation of the workpieces within a small angle of rotation of approximately 30°. The eccentric torques are correspondingly high. In contrast therewith, illustrated by a dot-dash line, is a classic toggle lever characteristic curve II, which produces an extended formation of the workpiece over a range of, for example, 80° of the eccentric shaft rotation. The tool is open, however, for only a relatively small part of the eccentric shaft rotation. The modified toggle lever transmission of press 1 in accordance with the invention results in path-time progressions which lie in a shaded region III. They differ particularly with regard to the stroke amplitudes, which can vary between 400 mm and 800 mm, for example. The approach to bottom dead center takes place matching a nearly linear characteristic curve.

Figure 5:
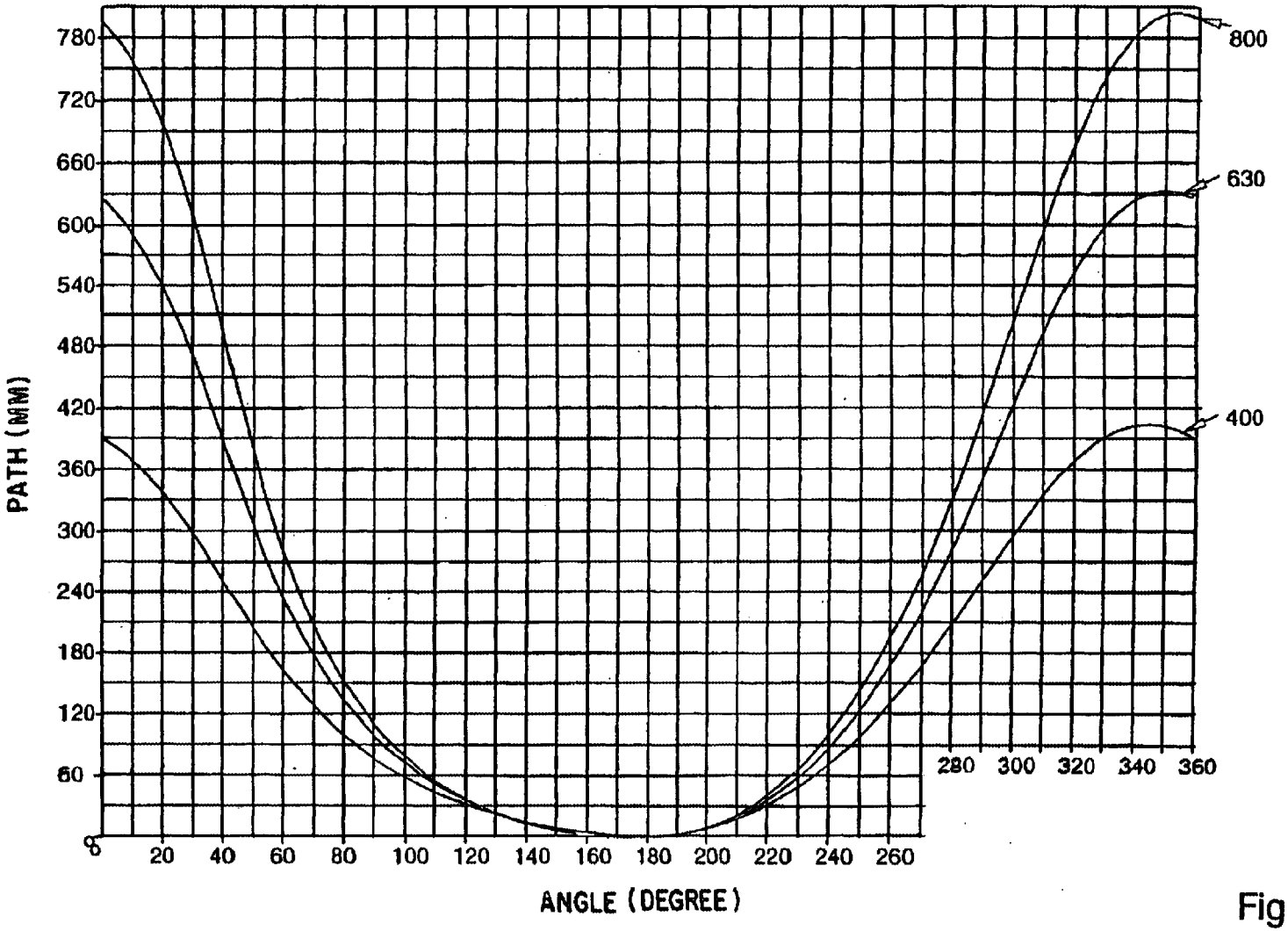
FIG. 5 is a graph of various path-time progressions of the slide movement of presses of a product line.

To achieve favorable transfer conditions, the path-time progression of the slide movement outside of the forming range (approaching bottom dead center) is made to approximate the eccentric characteristic. In the case of a press product line for 16,000 to 20,000 kN, the different slide strokes of, for example, 400 mm, 630 mm and 800 mm are achieved using the critical dimensions and distances; the associated movement curves are illustrated in FIG. 5.

TABLE 1

| | Slide stroke (mm) | | |
|---|---|---|---|
| Dimensions (mm) | 400 | 630 | 800 |
| E1 | 1690 | 1690 | 1690 |
| E2 | 800 | 800 | 800 |
| E3 | 1690 | 1690 | 1690 |
| E4 | 250 | 310 | 340 |
| E5 | 2110 | 2120 | 2125 |
| E6 | 2095 | 2159 | 2189 |
| E7 | 880 | 880 | 880 |
| E8 | 720 | 720 | 720 |
| E9 | 1387 | 1130 | 1024 |
| Realized stroke (mm) | 401.4 | 631.7 | 801.8 |

The critical dimensions E1, E2 and E3 are constant, independent of the stroke. The external dimension E4 varies by only 90 mm. The ES variation amounts to 15 mm, and can easily be produced by changing the bore point on the connecting rod 22. The somewhat greater variation of E6 by 94 mm can also be easily realized through a change in the bore point on the connecting rod. Dimension E8 is constant. Thus, despite the large stroke range, it is possible to achieve the production of a universal connecting rod and universal frame. Both can be produced for stock, i.e., produced in advance, possibly through the placement of an order. Once the stroke to be implemented is known, the bores are made at the corresponding locations on the connecting rod. This brings about both a reduction of costs through a decrease in the design effort (when compared with the production of several different connecting rods), as well as contributing to an advantageous shortening of delivery times. As can also be seen from Table 1 above, uniform link bars 31 can be used (E7 is constant). As lower link bars 32 have various lengths, special parts can be used there.

In the case of other press product lines (pressing force between 3150 and 4000, 6300 and 8000, 10,000 and 12,500 and 25,000 and 31,500 kN) it may be possible to get by with a smaller variation of the eccentric radius E4; under certain circumstances the other dimensions E5, E6, E7, E8 or E9 can vary somewhat more widely in order to accomplish this. In all cases, however, the critical dimensions E1, E2 and E3 are kept constant within a press product line in order to get by with uniform machine frames 2. As an example, shown in the following Table 2 are the dimensions E1 through E9 of the kinematics of a press product line which includes presses with pressing forces between 3150 and 4000 kN and various slide strokes. Under certain circumstances, the link bars 31, 32 can be produced from uniform blanks by changing the bore points. This also holds true for the connecting rod 22. The various eccentricities of the eccentric also differ so little from each other that a uniform blank can be used to start with.

TABLE 2

| | Slide stroke (mm) | | |
|---|---|---|---|
| Dimensions (mm) | 250 | 315 | 500 |
| E1 | 920 | 920 | 920 |
| E2 | 560 | 560 | 560 |
| E3 | 920 | 920 | 920 |
| E4 | 185 | 195 | 200 |
| E5 | 1180 | 1200 | 1265 |
| E6 | 1102 | 1155 | 1240 |
| E7 | 565 | 565 | 595 |
| E8 | 430 | 430 | 430 |
| E9 | 881 | 874 | 676 |
| Realized stroke (mm) | 251.9 | 316.4 | 501.6 |

In a press product line of presses 1 for massive forming with toggle lever transmissions 7 for driving the slide 3, different slide strokes and path-time characteristic curves of the slide movement are achieved starting with uniform blank components. The critical dimensions, i.e., the bearing locations of the toggle lever transmission 7 on the machine frame 2, are constant within the entire press product line, so that at least to that extent, uniform machine frames 2 can be used. Specially desired path-time progressions are achieved through appropriate fine machining of the blank components (eccentric, connecting rod and link bars).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. In a press of a press product line having a plurality of presses, the improvement comprising a machine frame, a guided slide configured for attachment of a first tool part, a slide drive operatively arranged on the machine frame and supported on at least one bearing arrangement on the machine frame so as to predetermine a path-time progression of the slide, and a table operatively arranged on the machine frame opposite the slide and configured for attachment of a second tool part, wherein the machine frame is configured such that a slide guide and a bearing arrangement of the slide drive are located so as to always coincide and remain unchanged in other of the plurality of presses in the press product line having different strokes or different path-time progressions of a press slide movement.

2. The press according to claim 1, wherein the machine frame has a head piece consisting of a component which is uniform for the entirety of the press product line.

3. The press product line with presses according to claim 1, wherein path-time progressions of slide movement of the presses of the press product line are different from each other.

4. In a press of a press product line having a plurality of presses, the improvement comprising a machine frame, a guided slide configured for attachment of a first tool part, a slide drive operatively arranged on the machine frame and supported on at least one bearing arrangement on the machine frame so as to predetermine a path-time progression of the slide, a table operatively arranged on the machine frame opposite the slide and configured for attachment of a second tool part, wherein the slide drive comprises a lever transmission having fixed bearing locations configured on the machine frame, and means for varying the slide drive such that other of the plurality of presses in the press line having different path-time progressions of slide movement have the same dimensions between the fixed bearing locations.

5. In a press of a press product line having a plurality of presses, the improvement comprising a machine frame, a guided slide configured for attachment of a first tool part, a slide drive configured as a lever transmission and having at least one eccentric, at least one connecting rod and at least one link bar, the slide drive supported on the machine frame on at least one bearing arrangement so as to predetermine a path-time progression of the slide, and a table arranged on the machine frame opposite the slide configured for attachment of a second tool part, wherein the at least one connecting rod, the at least one link bar, and the at least one eccentric are configured to be press-specific within the press product line and matched to a predetermined path-time progression, whereas other components of other of the presses in the press product line are press-general.

6. The press according to claim 5, wherein the slide drive is configured as a lever transmission and has on the connecting rod at least one connection region for the at least one link bar, the size of the at least one connection region being dimensioned to include an entire region in which the a bearing locations are placed within the press product line.

7. The press according to claim 5, wherein the lever transmission is a toggle lever transmission and the connecting rod is arranged to produce a connection between the at least one eccentric, which is bearing-supported on one of the fixed bearing locations on the machine frame, and two of the at least one link bar, one of the link bars being supported on the machine frame on a pivot bearing and the other of the link bars being supported on the slide.

8. The press according to claim 7, wherein the link bar is pivotably connected with the slide and is guided substantially within a pivoting range which is symmetrical to a guiding direction of the slide guide, the range being smaller than about 52°.

9. The press according to claim 7, wherein the connecting rod of one press of the press product line differs from connecting rods of other presses of the press product line only in a position of the bearing locations configured onto the connecting rods, whereby the connecting rods otherwise have the same basic dimensions.

10. The press according to claim 7, wherein the link bars of one press differ from link bars of other presses of the press product line only in a position of the bearing locations configured onto the link bars, whereby the link bars otherwise have the same basic dimensions.

11. The press according to claim 7, wherein an angle between the connecting rod and the link bar supported on the machine frame is greater than 38°.

12. In a press of a press product line having a plurality of presses, the improvement comprising a machine frame, a guided slide configured for attachment of a first tool part, a slide drive supported on the machine frame on at least one bearing arrangement so as to predetermine a path-time progression of the slide, and a table arranged on the machine frame opposite the slide and configured for attachment of a second tool part, wherein a bottom dead center position of the slide and installed height of the tool are uniform with other presses of the press product line even with different path-time progressions of slide movement, different stroke heights, different force-path progressions and/or a different number of strokes on the other presses of the press product line.

* * * * *